US011772842B2

(12) United States Patent
Lagrou

(10) Patent No.: US 11,772,842 B2
(45) Date of Patent: Oct. 3, 2023

(54) PACKAGE WITH REINFORCED LINES OF WEAKNESS FOR STORAGE AND TRANSPORT

(71) Applicant: The Hershey Company, Hershey, PA (US)

(72) Inventor: James Lagrou, Elizabethtown, PA (US)

(73) Assignee: THE HERSHEY COMPANY, Hershey, PA (US)

( * ) Notice: Subject to any disclaimer, the term of this patent is extended or adjusted under 35 U.S.C. 154(b) by 40 days.

(21) Appl. No.: 16/717,483

(22) Filed: Dec. 17, 2019

(65) Prior Publication Data

US 2021/0179317 A1 Jun. 17, 2021

(51) Int. Cl.

| | |
|---|---|
| ***B65D 5/54*** | (2006.01) |
| ***B65D 5/02*** | (2006.01) |
| ***B65D 71/00*** | (2006.01) |
| ***B65D 5/00*** | (2006.01) |

(52) U.S. Cl.

CPC ..... *B65D 5/542* (2013.01); *B65D 5/001* (2013.01); *B65D 5/0281* (2013.01); *B65D 71/0096* (2013.01)

(58) Field of Classification Search

CPC ..... B65D 5/16; B65D 5/0281; B65D 5/542; B65D 5/5445; B65D 5/001; B65D 25/54

USPC .. 229/122, 122.32, 207, 240, 241–242, 919, 229/915; 206/774, 736, 738

See application file for complete search history.

(56) References Cited

U.S. PATENT DOCUMENTS

| | | | | |
|---|---|---|---|---|
| 5,950,914 | A * | 9/1999 | Dunton | B65D 5/5405 229/122 |
| 6,073,833 | A * | 6/2000 | Desrosiers | B65D 5/5445 229/164 |
| 6,189,780 | B1 * | 2/2001 | Kanter | B65D 5/542 229/164 |
| 7,293,694 | B2 * | 11/2007 | Weimer, Jr. | B65D 5/5021 229/120.35 |
| 9,290,294 | B2 * | 3/2016 | Laughman | B31B 50/26 |
| 2012/0074037 | A1 * | 3/2012 | Orischak | B65D 5/5405 206/736 |
| 2015/0375892 | A1 * | 12/2015 | Hamilius | B65D 5/54 206/459.5 |
| 2019/0009946 | A1 * | 1/2019 | Nixon | B65D 5/542 |

FOREIGN PATENT DOCUMENTS

| | | | | |
|---|---|---|---|---|
| EP | 1535849 | A2 * | 6/2005 | B65D 5/5445 |

* cited by examiner

*Primary Examiner* — Nathan J Newhouse
*Assistant Examiner* — Phillip D Schmidt
(74) *Attorney, Agent, or Firm* — Jordan IP Law, LLC

(57) ABSTRACT

The present invention is a package having strengthened, reinforced lines of weakness. More particularly, the package, in its fully formed configuration, provides for a self-reinforced package and strengthened, reinforced lines of weakness for stacking and transport wherein the package is resistant to fracture at its lines of weakness due to jostling of its contents against the inside of the package and at its lines of weakness.

22 Claims, 8 Drawing Sheets

PACKAGE WITH REINFORCED LINES OF WEAKNESS FOR STORAGE AND TRANSPORT

FIELD OF THE INVENTION

The present invention is a package having strengthened, reinforced lines of weakness. More particularly, the package, in its fully formed configuration, provides for a self-reinforced package and strengthened, reinforced lines of weakness for stacking and transport wherein the package is resistant to fracture at its lines of weakness due to jostling of its contents against the inside of the package and at its lines of weakness. Also provided herein are strengthened, self-reinforced stacked structures that are suitable for storage and transport.

BACKGROUND OF THE INVENTION

Outer cases, such as cartons, made from cardboard, paperboard, or similar materials are well known and used for transporting and storing various types of articles, including retail articles and the like. Shelf ready packaging are a means for packaging a plurality of articles in outer cases in a manner that they can be displayed, for instance on a supermarket shelf or aisle, directly from the outer case without first having to remove the articles from the outer case. The individual articles, contained within the shelf ready packaging, can be individual packets, cans, bottles, bags, boxes, and the like. Typically, the shelf ready packaging has a removable element, formed by a line of weakness in the outer-case, which can be easily or readily removed. Once the removable element has been removed, the articles contained within are displayed to the customer, and the customer is able to remove the displayed article.

Shelf ready packaging avoids the time consuming effort associated with removing articles from the outer case and placing the articles onto shelves. Store owners are constantly looking for additional ways by which to reduce costs for stacking articles, while ensuring that the article remains presentable to customers. Such shelf ready packaging is typically placed adjacent to other shelf ready packaging, e.g., on a shelf or even on a pallet, and the removable element removed in order to display the articles contained therein. The shelf ready packages can even be stacked on top of each other, on the pallet or directly on the floor of a storage facility.

Since the articles will be displayed in the shelf ready package, the outer surfaces thereof are often decorated with images and wording that is relevant for the articles contained therein. The outer surfaces of shelf ready package are often decorated such that the overall impression from a stack or row of the shelf ready packages is improved.

Stacked packages in transport or in storage are subject to jostling that is either mild or intense depending upon the forces applied to such packages whether singular or in a stacked configuration (i.e., a stacked structure) of more than one package. Often, packages contain rigid items like plastic or glass bottles that are weighty due to the substances that they contain or because of the makeup of the rigid items themselves. Such weight can cause internal stress and even failure to the packages carrying them given the motion of items housed within the packages.

When rigid items within display packages are jostled, internal damage to the packages can occur. Particularly when such packages contain lines of weakness (i.e., perforations), the lines of weakness can be broken thereby enabling a package's contents to spill out thereby causing full package failure. If such packages fail while in a transportable, stacked configuration, an entire transportable unit can be compromised thereby destroying more packages and damaging product contained therein.

What is therefore needed is a stackable package having lines of weakness for ease of access to the transported product therein that will not easily fail when stored or transported in either singular or stacked configuration as a transportable unit.

SUMMARY OF THE INVENTION

Accordingly, the invention provides a container assembly having a blank that comprises a first panel; a second panel attached to the first panel; a third panel attached to the second panel, the second panel being attached in series between the first panel and the third panel; a fourth panel attached to the third panel, the third panel being attached in series between the second panel and the fourth panel; a fifth panel attached to the fourth panel, the fifth panel having multiple lines of weakness, the fourth panel being attached in series between the third panel and the fifth panel, the fifth panel having at least one line of weakness; and a sixth panel attached to the fifth panel, the sixth panel having at least one line of weakness, the fifth panel and the sixth panel being attachable to the first panel and the second panel whereby the lines of weakness in the fifth panel and the sixth panel are positioned adjacent to the first panel and the second panel.

The first panel and the second panel each have an inside surface and an outside surface positioned oppositely to the inside surface. The outside panel of the first panel and the second panel face outwardly from the container assembly when the container assembly is constructed into a package. The inside panel of the first panel and the second panel face inwardly toward the container assembly when the container assembly is constructed into a package. Lines of weakness are positioned adjacent to the inside surface of the first panel and the second panel. In practice, at least a portion of the lines of weakness are reinforced by the construction of the package itself.

The blank is, of course, constructible into a package. When used, especially in transport, the constructed package houses one or more rigid items, e.g., bottles of chocolate syrup, laundry detergent, fabric softener, and like other like items storable in plastic or glass bottles or other like packaging. Preferably, the one or more rigid items are geometrically similar and most preferably geometrically the same. During transport, the one or more rigid items stored within a package herein are arrangeable in a two by five orientation within a package. When packaged, at least two of the one or more rigid items are positioned adjacent to one or more lines of weakness and may be held static next to one or more lines of weakness.

Herein, the packages formed from the described container assembly are stackable. In practice, a package is stacked amongst several similar such packages to form a transportable unit. In transit or in stationary storage, a package of the transportable unit herein produces no more than ten percent (10%) tear of the lines of weakness for any one package and for the transportable unit as a whole. In transit or in stationary storage, each package of the transportable unit herein produces no more than five percent (5%) tear of the lines of weakness for any one said package and for the transportable unit as a whole. In transit or in stationary storage, each package of the transportable unit comprises no more than one-half percent (2.5%) tear of the lines of weakness for any one said package and for the transportable unit as a whole. In transit or in stationary storage, each package of the transportable unit herein produces no more than one percent (1%) tear of the lines of weakness for any one said package and for the transportable unit as a whole.

The fifth and sixth panels each comprise at least one horizontal line of weakness. Also, the fifth and sixth panel each comprise at least one vertical line of weakness.

Also provided is a self-reinforced stacked structure comprising multiple self-reinforced container assemblies, each multiple self-reinforced container assembly formed from a blank and having:

a. A first panel;
b. A second panel attached to the first panel;
c. A third panel attached to the second panel, the second panel being attached in series between the first panel and the third panel;
d. A fourth panel attached to the third panel, the third panel being attached in series between the second panel and the fourth panel;
e. A fifth panel attached to the fourth panel, the fifth panel having multiple lines of weakness, the fourth panel being attached in series between the third panel and the fifth panel, the fifth panel having at least one line of weakness; and
f. A sixth panel attached to the fifth panel, the sixth panel having at least one line of weakness, the fifth panel and the sixth panel being attachable to the first panel and the second panel whereby the lines of weakness in the fifth panel and the sixth panel are positioned adjacent to the first panel and the second panel, wherein the self-reinforced stacked structure is strengthened and reinforced by each self reinforced container assembly that forms and makes the self-reinforced stacked structure.

BRIEF DESCRIPTION OF THE FIGURES

The various exemplary embodiments of the present invention, which will become more apparent as the description proceeds, are described in the following detailed description in conjunction with the accompanying drawings, in which.

DETAILED DESCRIPTION OF THE INVENTION

Figure 1A:
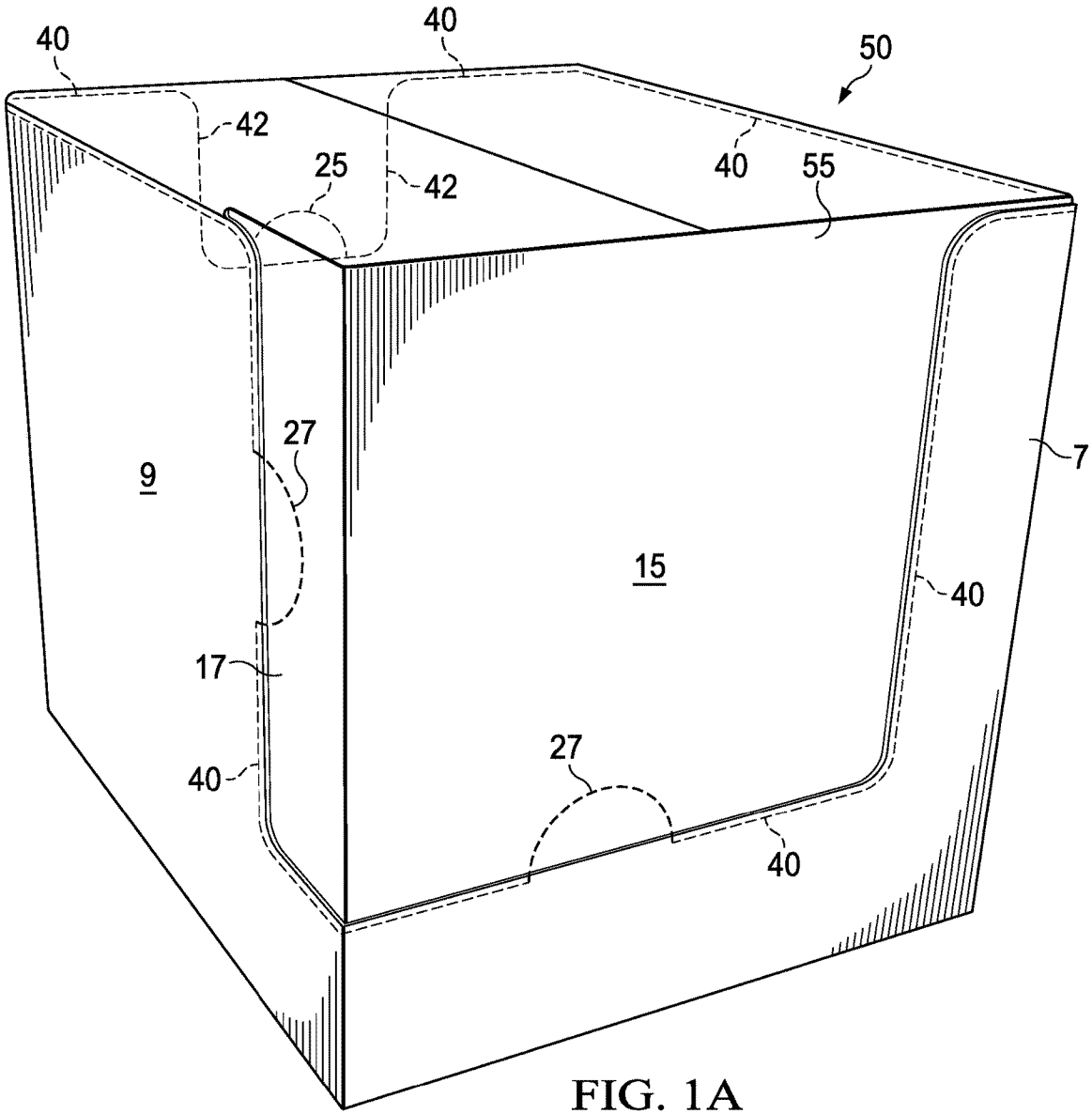
FIG. 1A is a perspective view of the front of the package herein.

By the term "lines of weakness" it is meant herein perforations scored into a blank or package.

By the term "transportable unit" or "stacked transportable unit" it is meant herein a stacked assembly of multiple packages herein stacked and secured for transport as one unit.

By the term "stacked structure" it is meant herein a stacked collective of multiple packages herein stacked, secured or unsecured, for storage as one unit, and typically resting upon a pallet.

By the term "self-reinforced container assembly" it is meant herein a package formed from a single blank that has one or more sections of the package reinforced by one or more sections of the same package without the use of an external material (e.g., tape, cardboard) applied to the outside of the inventive package herein. This does not include the use of tape applied to a package herein for the closing thereof.

The invention provides a container assembly having a blank that comprises a first panel; a second panel attached to the first panel; a third panel attached to the second panel, the second panel being attached in series between the first panel and the third panel; a fourth panel attached to the third panel, the third panel being attached in series between the second panel and the fourth panel; a fifth panel attached to the fourth panel, the fifth panel having multiple lines of weakness, the fourth panel being attached in series between the third panel and the fifth panel, the fifth panel having at least one line of weakness; and a sixth panel attached to the fifth panel, the sixth panel having at least one line of weakness, the fifth panel and the sixth panel being attachable to the first panel and the second panel whereby the lines of weakness in the fifth panel and the sixth panel are positioned adjacent to the first panel and the second panel.

The first panel and the second panel each have an inside surface and an outside surface positioned oppositely to the inside surface. The outside panel of the first panel and the second panel face outwardly from the container assembly when the container assembly is constructed into a package. The inside panel of the first panel and the second panel face inwardly toward the container assembly when the container assembly is constructed into a package. Lines of weakness are positioned adjacent to the inside surface of the first panel and the second panel. In practice, at least a portion of the lines of weakness are reinforced by the construction of the package itself.

The single blank is, of course, constructible into a package. When used, especially in transport, the constructed package houses one or more rigid items, e.g., bottles of chocolate syrup, laundry detergent, fabric softener, and like other like items storable in plastic or glass bottles or other like packaging. Preferably, the one or more rigid items are geometrically similar and most preferably geometrically the same. During transport, the one or more rigid items stored within a package herein are arrangeable in a two by five orientation within a package. When packaged, at least two of the one or more rigid items are positioned adjacent to one or more lines of weakness and may be held static next to one or more lines of weakness.

Herein, the packages formed from the described container assembly are stackable. In practice, a package is stacked amongst several similar such packages to form a transportable unit. In normal or standard transit or in normal or standard stationary storage, a package of the transportable unit herein produces no more than ten percent (10%) tear of the lines of weakness for any one package and for the transportable unit as a whole. In transit or in stationary storage, each package of the transportable unit herein produces no more than five percent (5%) tear of the lines of weakness for any one said package and for the transportable unit as a whole. In transit or in stationary storage, each package of the transportable unit comprises no more than one-half percent (2.5%) tear of the lines of weakness for any one said package and for the transportable unit as a whole. In transit or in stationary storage, each package of the transportable unit herein produces no more than one percent (1%) tear of the lines of weakness for any one said package and for the transportable unit as a whole. All of the above percentages herein are applicable to normal or standard transit or storage of which persons of skill in the art will be familiar and knowledgeable.

The fifth and sixth panels each comprise at least one horizontal line of weakness. Also, the fifth and sixth panel each comprise at least one vertical line of weakness.

Also provided is a self-reinforced stacked structure comprising multiple self-reinforced container assemblies, each multiple self-reinforced container assembly formed from a blank and having:

a. A first panel;
b. A second panel attached to the first panel;
c. A third panel attached to the second panel, the second panel being attached in series between the first panel and the third panel;
d. A fourth panel attached to the third panel, the third panel being attached in series between the second panel and the fourth panel;
e. A fifth panel attached to the fourth panel, the fifth panel having multiple lines of weakness, the fourth panel being attached in series between the third panel and the fifth panel, the fifth panel having at least one line of weakness; and
f. A sixth panel attached to the fifth panel, the sixth panel having at least one line of weakness, the fifth panel and the sixth panel being attachable to the first panel and the second panel whereby the lines of weakness in the fifth panel and the sixth panel are positioned adjacent to the first panel and the second panel, wherein the self-reinforced stacked structure is strengthened and reinforced by each self-reinforced container assembly that forms and makes the self-reinforced stacked structure.

The advantages of the strengthened, self-reinforced package herein are several. First, it is constructed from a single blank instead of two or more pieces as is prevalent in the prior art. This provides distinct advantages in cost, ease of engineering, manufacturing assembly, manufacturing line errors and in-line fixes. As but one example, many package folder gluers are limited to the number of folds and glue applications they can perform in a single pass in a manufacturing line. Two-piece packages typically require two passes (i.e., more time) on older folder gluers or one pass on a specialty folder gluer. Specialty folder gluer availability, set-up time, and the additional material from a two-piece package can all add cost, time or both.

Furthermore, the package herein is unique because it has an open corner with reinforced perforations, and it is able to achieve that with a single blank in a one-pass gluer operation. This one pass manufacturing operation is particular important for cost savings, time and ease of manufacturing. This is especially true in high-speed package manufacturing systems. Such a system for the creation of open corner packages is novel and unique.

The package herein therefor provides the benefits of ready display of package contents in a commercial setting while also providing a strengthened, self-reinforced package for both storage and transport. Further, the open corner design of the package herein delivers an improved shopping experience for the customer, especially for rigid containers transported and contained therein. Adding perforations to such a package herein decreases the vertical compression potential of the package and can transfer its vertical load to the containers inside the case. Therefore, the rigidity of the rigid items within each package provides additional strength to the package herein.

If too much vertical load is applied to the bottles, (i.e., rigid items), deformation thereof can occur over time. By adding the fifth and sixth panels herein from the single blank, the packages strength is increased. Other cases that do not include the fifth and sixth panels herein will not perform as well and will show perforation tears on a store shelf as those perforations (i.e., lines of weakness) give way or are punctured.

Figure 1B:
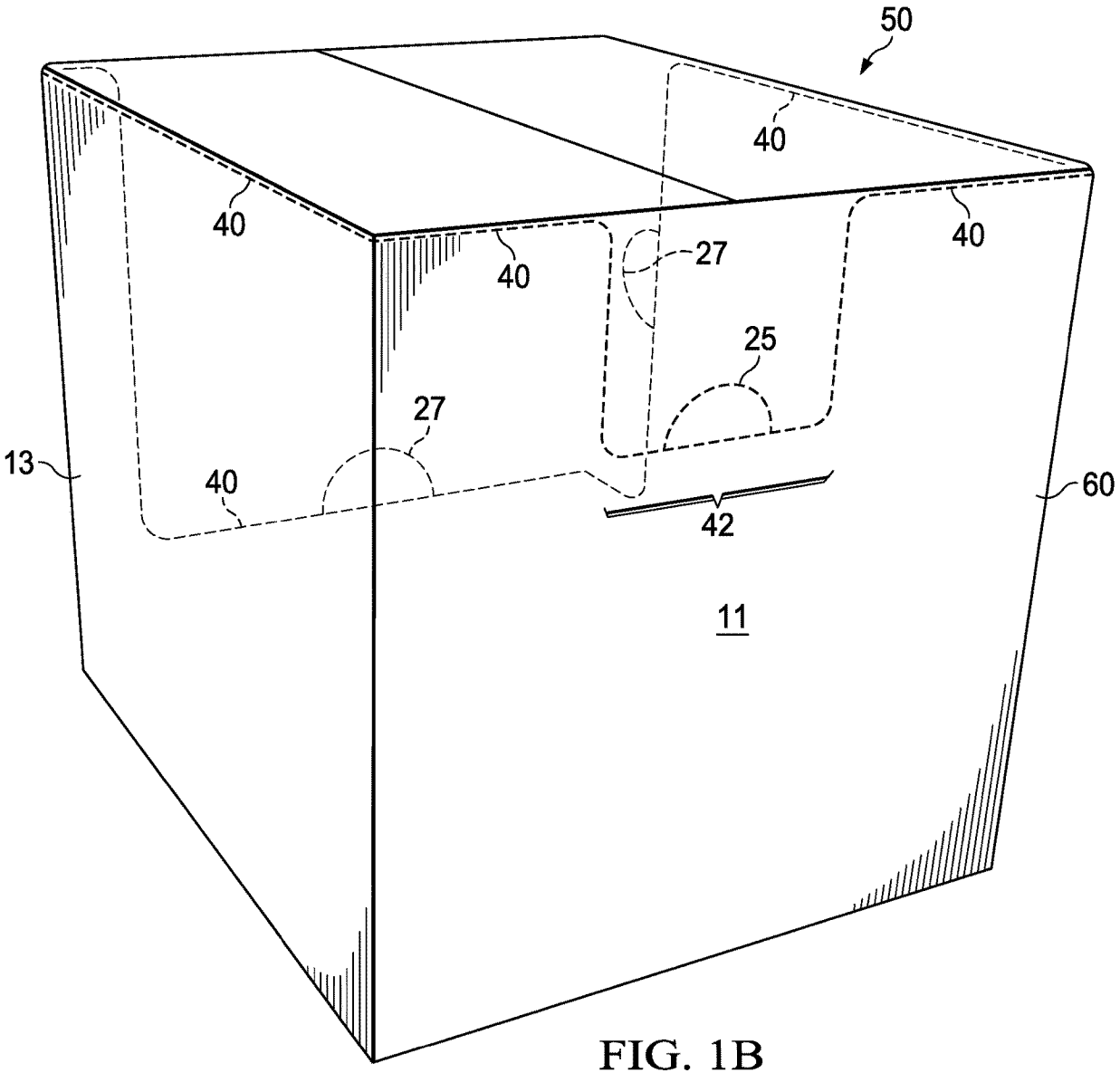
FIG. 1B is a perspective view of the rear of the package in FIG. 1A.

FIG. 1A provides a perspective view of package 50. It is shown completely formed. Lines of weakness 40 (i.e., perforations 40) are shown extending from its front surface 55 to its rear surface 60 (FIG. 1B). Perforations 40 are shown as a horizontal line and a vertical line on fifth panel 15 tucked below first panel 7. Perforations 40 are also shown as a horizontal line and a vertical line tucked beneath second panel 9 and on sixth panel 17, a side surface to package 50. Also shown are perforations 40 extending along the top of second panel 9 and fourth panel 13 (FIG. 2) and along the top of third panel 11 until perforations 40 dip down into caved section 42.

Multiple side pull-tabs 27 are shown in FIG. 1A. Also shown is caved section 42 positioned onto third panel 11 on the rear surface 60 of package 50. Rear pull-tab 25 is positioned within caved section 42. In practice, a user will apply a digit into rear pull-tab 25 and pull it and caved section 42 apart in an upwardly fashion. At such pull, all of the perforated area functioning as removable section 65 pulls away from the remainder of package 50 thereby exposing its contents.

FIG. 1B provides a perspective view of the rear of package 50. Prominently shown is caved section 42 with its rear pull-tab 25 built therein. Fourth panel 13 is also shown. Perforations 40 are also shown all of which form the perimeter of removable section 65. As noted previously herein, removal of removable section 65 exposes the contents of package 50 similar to those shown in FIG. 3.

Figure 2:
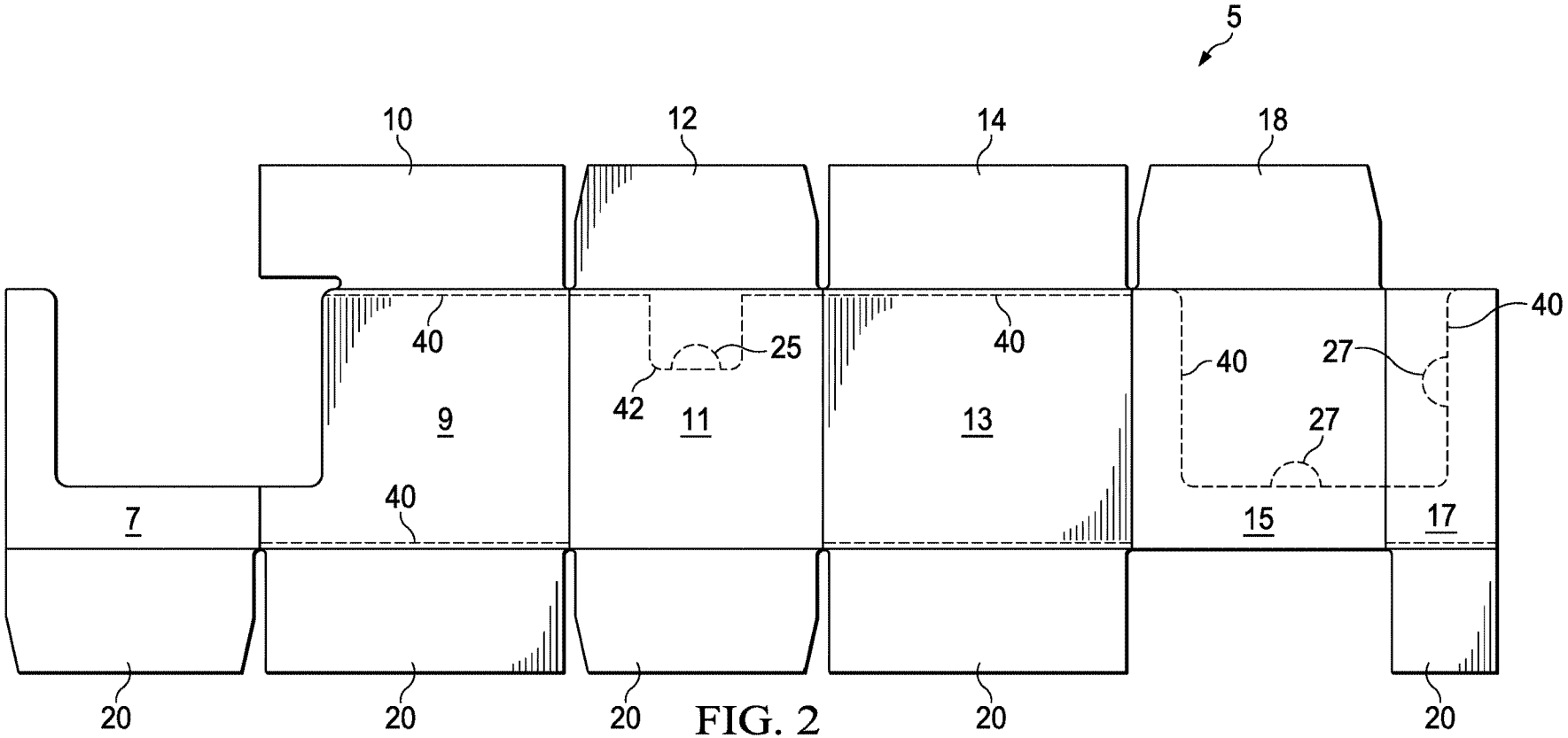
FIG. 2 is a planar view of the blank of the package of FIGS. 1A and 1B.

Package 50 is formed from blank 5 (FIG. 2). Blank 5 is formed from a single structure having first panel 7, second panel 9, third panel 11, fourth panel 13, fifth panel 15 and sixth panel 17. As shown in FIGS. 1A and 1B, formed package 50 shows first panel 7, second panel 9, third panel 11 and fourth panel 13. Fifth panel 15 and sixth panel 17 are partially but not fully hidden from view. In practice, fifth panel 15 and sixth panel 17 are fixedly attached to first panel 7 and second panel 9, respectively by, preferably, glue formulated to enact and maintain a strong bond between the attached panels. Persons of skill in the art will readily know and recognize the commercially available types of glues suitable for the attachment of the panels of blank 5 to one-another.

More specifically, fifth panel 15 is attached to the inner surface of first panel 7 with perforations 40. Also, sixth panel 17 is attached to the inner surface of second panel 9 with perforations 40.

As shown in FIG. 2, the attachment of fifth panel 15 to the inner surface of first panel 7 and sixth panel 17 to second panel 9 provides a reinforcement to package 50 when constructed. Importantly, this reinforcement occurs from blank 5 itself without the addition of any outside strengthening means. Fifth panel 15 and sixth panel 17 provide strengthening and reinforcement to package 50 when formed from blank 5 for storage of rigid items 30 (FIG. 3), transport of rigid items 30 and stacking of multiple packages 50 into stacked structure 70 (FIGS. 4 and 5) and/or transportable unit 75.

Perforations 40 positioned onto fifth panel 15 and sixth panel 17 and which are hidden behind first panel 7 and second panel 9 are strengthened and reinforced by their placement. Portions of fifth panel 15 and sixth panel 17 are attached to the inward surfaces of first panel 7 and second panel 9, respectively. As submerged perforations 40 are hidden and pressed against the inside of first panel 7 and second panel 9, they are both protected from damage and strengthened due to their attached association to the inside of first panel 7 and second panel 9.

First panel 7 comprises bottom flap 20, as is shown FIG. 2. Second panel 7 comprises top flap 10 and a bottom flap 20. Third panel 11 comprises top flap 12 and a bottom flap 20. Fourth panel 13 comprises top flap 14 and bottom flap 20. Fifth panel 15 comprises top flap 18. Sixth panel 17 comprises bottom flap 20.

When package 50 is formed and closed, top flaps 10, 12, 14 and 18 of their respective panels form the top or ceiling of package of 50. Similarly, bottom flaps 20 form the bottom of floor of package 50 upon which rigid items 30 reside.

As is shown in FIGS. 1A, 1B and 2, lines of weakness 40 (i.e., perforations 40) exist throughout blank 5 and therefore package 50 when formed. Perforations 40 serve to outline removable section 45 which is removed, typically, by a user when package 50 is opened in a retail space, i.e., for displaying sale of rigid items 30 transported therein.

Figure 3:
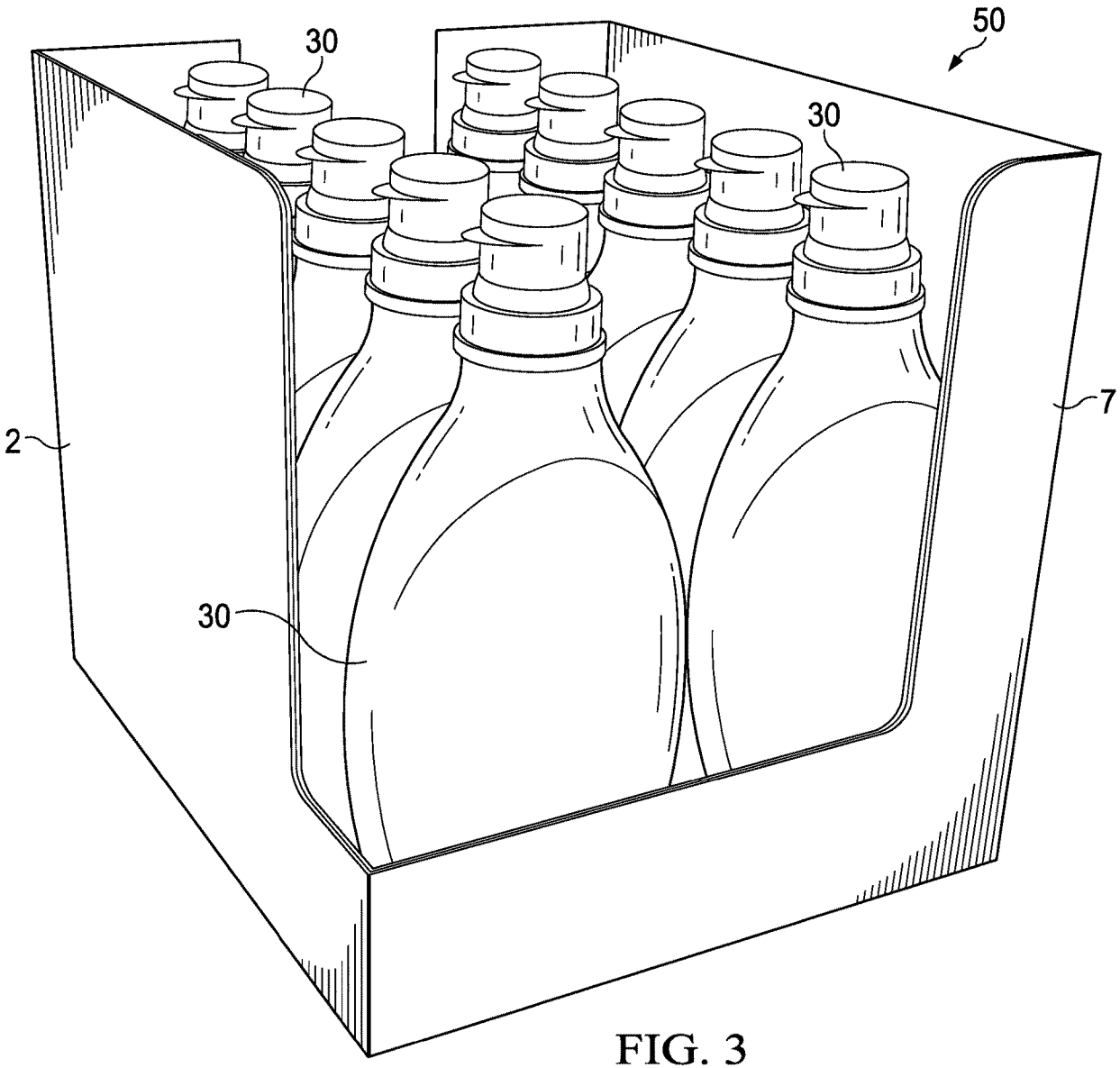
FIG. 3 is a perspective view of the package of FIG. 1A with rigid items positioned therein.

Third panel 11 contains a u-shaped caved section 42 formed by a portion of perforations 40 and includes rear pull-tab 25. When a user seeks to expose the contents of package 50 for retail sale, the user grasps caved section 42 at rear pull tab 25 and pulls upwardly. At such pull, caved section 42 readily detaches along all other perforations 40 thereby revealing the contents of package 50 as is shown in FIG. 3 herein.

Lines of weakness 40 or perforations 40 exist on all panels of blank 5 as shown in FIG. 1 except for first panel 7. Caved section 42 is constructed to be grasped by a user at rear pull-tab 25, pulled upwardly and then used to pull apart the remainder of perforations 40 thereby exposing the inside of package 50 and any contents therein. All perforations 40 taken together define a removable section 65. Removable section 65 substantially covers the top of package 50 and the tops of rigid items 30 packed therein. Once removable section 65 is removed, it can be discarded or preferably recycled as all such corrugate materials can and should be.

As has been noted extensively above herein, package 50 herein is formed from blank 5. Blank 5 is formed from corrugate/card board that is well known by persons of skill in the art for use in corrugated packaging. FIG. 2 shows first panel 7, second panel 9, third panel 11, fourth panel 13, fifth panel 15 and sixth panel 17. When constructed into package 50, fifth panel 15 and sixth panel 17 attach to first panel 7, preferably by some adhesive means well known to persons of skill in the art. The attachment of fifth panel 15 and sixth panel 17 to first panel 7 provides a reinforced, strengthened package 50 once constructed.

Reinforced, strengthened package 50 constructed from blank 5 is made stronger for both stacking and for transport of rigid items 30 due to its unique construction. Package 50 is reinforced and strengthened without any additional component or components added to it other than adhesive that attaches several of the panels together. For example, the prior art uses components like tape to secure and strengthen packages that are not themselves reinforced like package 50 is. The addition of outside materials like tape or an additional, unattached piece of corrugate to strengthen a package meant either for stacking and storage with other packages and/or for transport with one or more rigid items 30 (FIG. 3) is problematic.

By the term "additional, unattached piece of corrugate", it is meant herein a piece of corrugate material for use with a corrugate package that is added to the package at formation thereof that is not attached to the blank from which the package is formed.

The addition of such outside materials to strengthen a package is costly and can often add complexity to a manufacturing or packaging process can add human error given that placement of any outside material, especially when placed outside of a package, will often be added manually rather than mechanically. Such manual addition can lend itself to human error and further additional costs. Lastly, depending upon the attachment means used by an outside material to strengthen a package, such outside material can become loose or removed in adverse conditions (e.g., high heat, severe cold, severe jostling, unstable packing, etc.). If such loosening or removal occurs, the strength and integrity of the subject package is compromised, and its utility is therefore diminished.

Ultimately, any package's use of tape or another secondary fastening and/or strengthening means is undesired herein. If a secondary strengthening means is attached to a package and it becomes undone or otherwise compromised, the entire package's strength is itself comprised and that of any neighboring packages to which the compromised package is attached. This also includes stacked structure 70 to which a compromised package becomes a part.

Such compromise of a package itself and/or as part of stacked structure for either storage and/or transport is a key problem that reinforced, strengthened package 50 seeks to overcome. Package 50 provides internal strengthening measures fully explained herein from single blank 5.

In transport or in storage, rigid items 30 are stored within package 50 in a manner that limits movement within package 50. However, movement of rigid items 30 still occurs. FIG. 3 provides a perspective view of rigid items 30 in package 50. Ideally, suitable rigid items 30 sit upright within package 50, as shown, and are oriented to fit snuggly (i.e., with little motion) therein. Preferably, rigid items 30 positioned within package 50 are as tall or nearly as tall as the top of package 50.

It is important to point out that package 50 herein provides reinforced lines of weakness 30 that are strengthened and reinforced by package 50 itself without the inclusion of a secondary strengthening means like tape and the like. For example, EP 2962949, U.S. Pat. No. 5,950,914, and U.S. patent application Ser. No. 15/032,9235 all use tape to strengthen their respective packages. The packages thereof, though they may contain lines of weakness (i.e., perforations) are therefore not reinforced by each of the respective packages themselves, but are instead dependent upon an outside source to be strengthened.

Rigid items 30 are shown positioned in package 50 in two by five formation. Of course, a user or manufacturer of package 50 may position as many suitable rigid items 30 as is practicable. For suitably sized rigid items 30, any practicable number may be placed within package 50; e.g., three across by at least three deep; four across by at least three deep; two across by at least three deep, etc. The number of rigid items 30 placed within package 50 is a matter of design choice. Ideally, rigid items 30 placed within package 50 are fit snugly therein such that little if any motion of rigid items 30 when moved, or stacked upon (i.e., packages 50 thereof) or when transported.

In transport, rigid items 30 may jostle about within package 50 and press against the inner walls of package 50. At such pressing, lines of weakness 40 are pressed and impacted by rigid items 30. As lines of weakness 40 are impacted, they are stressed and tend toward disruption, i.e., tear apart, but within package 50 substantially do not tear apart because perforations 40 positioned behind and attached to first panel 7 and second panel 9 are reinforced thereby strengthening package 50 overall. Lines of weakness 40 substantially do not tear apart when package 50 is either stacked in storage or transported (i.e., singly or in a transportable unit 75). Lines of weakness 40 substantially do not break apart in either of these conditions because of a) their placement and b) their orientation with respect to one or more panels herein, each condition causing lines of weakness 40 to be strengthened and reinforced as has been well noted.

Figure 4:
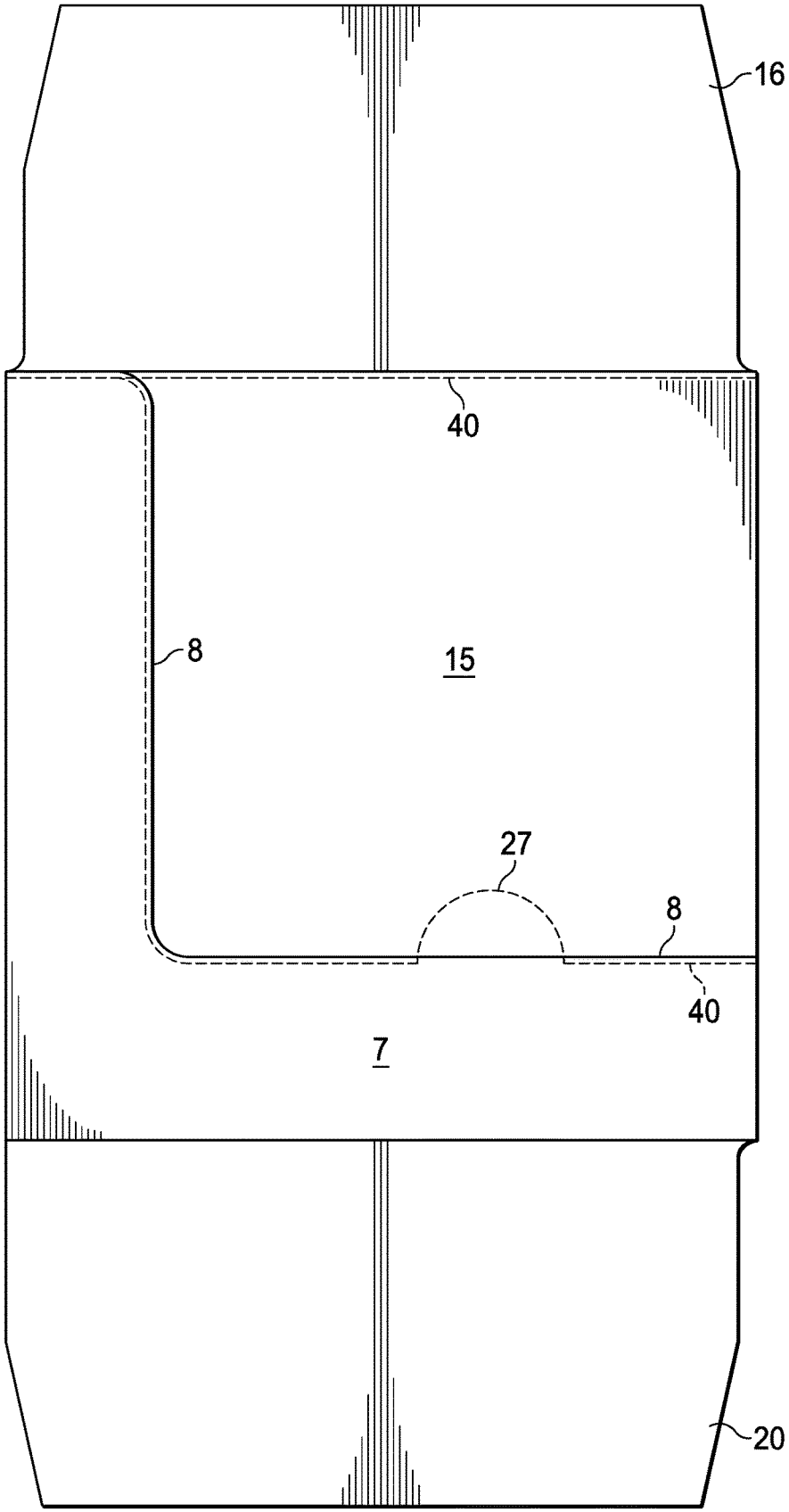
FIG. 4 is a planar view of the first panel and the fifth panel herein.

For example, some of perforations 40 on fifth panel 15 rests behind first panel 7 as is shown in FIG. 4 herein. More specifically, about two-thirds of the perforations 40 of fifth panel 15 lie just below leading edge 8 of first panel 7. The remaining, approximately one-third of perforations 40 of fifth panel 15 lie in or about the crease connecting top lid flap 16 to fifth panel 15.

Figure 5:
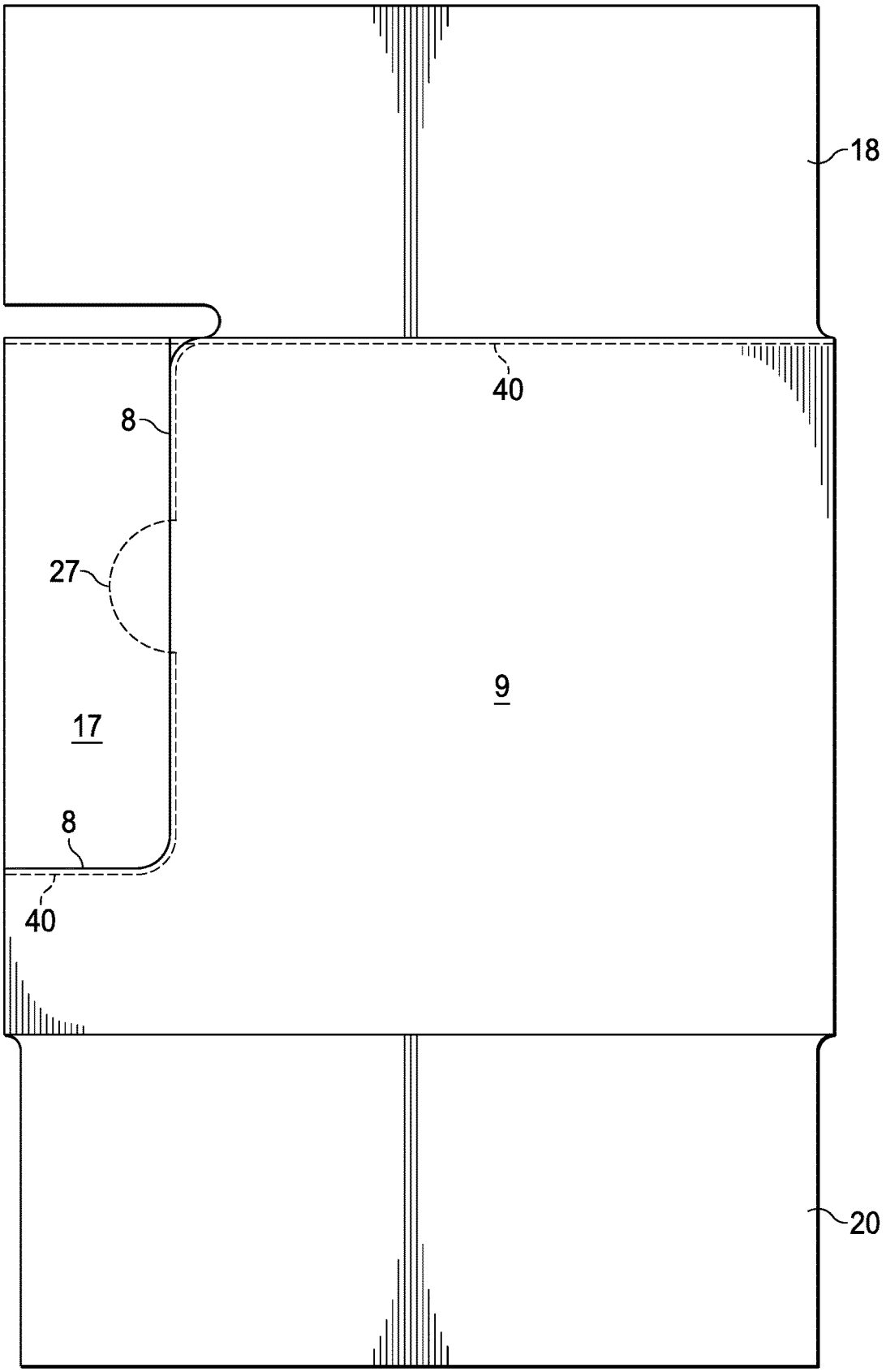
FIG. 5 is a planar view of the second panel and the sixth panel herein.

As is shown in FIG. 4, FIG. 5 shows that placement of perforations 40 below leading edge 8 of first panel 7 decreases the probability that such perforations 40 will be torn when package 50 comes under stress and is stored, stacked or transported. Perforations 40 of fifth panel 15 positioned onto the inside face of first panel 7 are strengthened against tearing, because the inside face of first panel 7 provides a counter-force against perforations 40 when rigid items 30 press against them from the opposite direction.

FIG. 5 provides a planar view of second panel 9 and sixth panel 17 herein. As is shown in FIG. 2, second panel 9 and first panel 7 are connected to one-another and share a line of attachment. Top lid flap 18 is attached to sixth panel 17 and folds over to help close the top of package 50. Bottom flap 20 is attached oppositely to top lid flap 18 and is used to help close the bottom of package 50. Also shown in FIG. 5 are perforations 40.

As in FIG. 4, some perforations 40 are shown running along the length of leading edge 8. In practice, as is shown, perforations 40 sit just below leading edge 8. Placement of perforations 40 below leading edge 8 of second panel 9 decreases the probability that such perforations 40 will be torn when package 50 is stored, stacked or transported thereby reinforcing them. Perforations 40 of sixth panel 17 positioned onto the inside face of second panel 9 are strengthened against tearing, because the inside face of second panel 9 provides a counter-force against perforations 40 when rigid items 30 press against them from the opposite direction.

Figure 6:
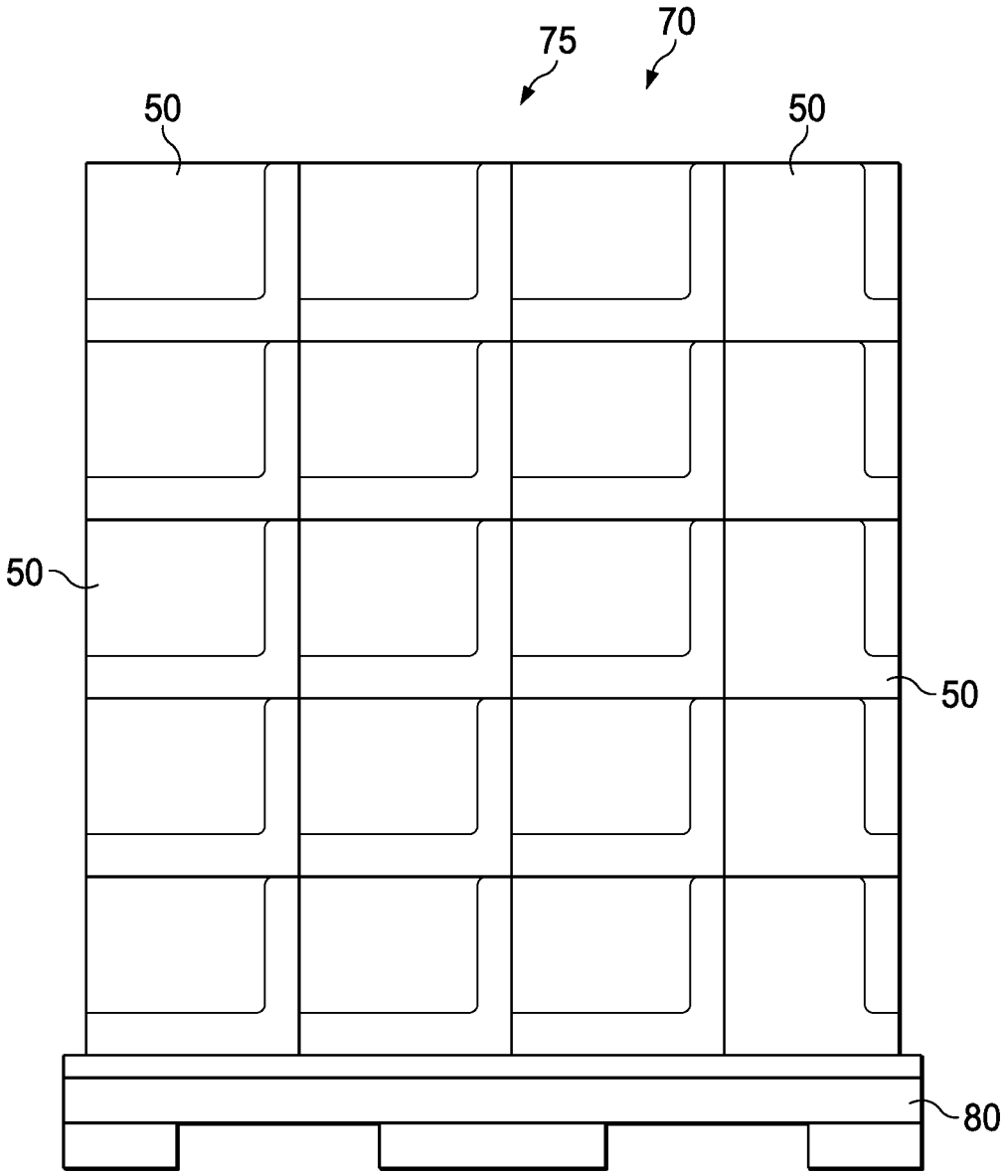
FIG. 6 is a planar view of a stacked, transportable unit.

FIG. 6 is a planar view of stacked structure 70 or transportable unit 75 herein. Shown are stacked packages 50 that comprise each stacked structure 70 or transportable unit 75. Transportable unit 75 also serves as stacked structure 70 when such structure is merely stored or held and is not actively transported. Whether as stacked structure 70 or transportable unit 75, each receives the benefit of each reinforced, strengthened package 50 contained therein. More specifically, as each package 50 is itself strengthened and reinforced, as discussed at length herein, any stacked structure 70 or transportable unit 75 herein is also thereby strengthened and reinforced.

Strengthened and reinforced stacked structure 70 and/or transportable unit 75 provides several important benefits. First, both structures are less likely to fail in either storage or transport. Second, as outside forces are applied to either structure through either accidental collision, as often happens in storage facilities, or through normal transport, stacked structure 70 and/or transportable unit 75 are able to resist those forces at a greater and more consistent level than other non-reinforced or strengthened structures. Thirdly, by being strengthened and reinforced, stacked structure 70 and/or transportable unit 75 are subject to fewer injury-causing accidents. The avoidance of such accidents to humans in either storage or transport conditions is highly critical and necessary.

Figure 7:
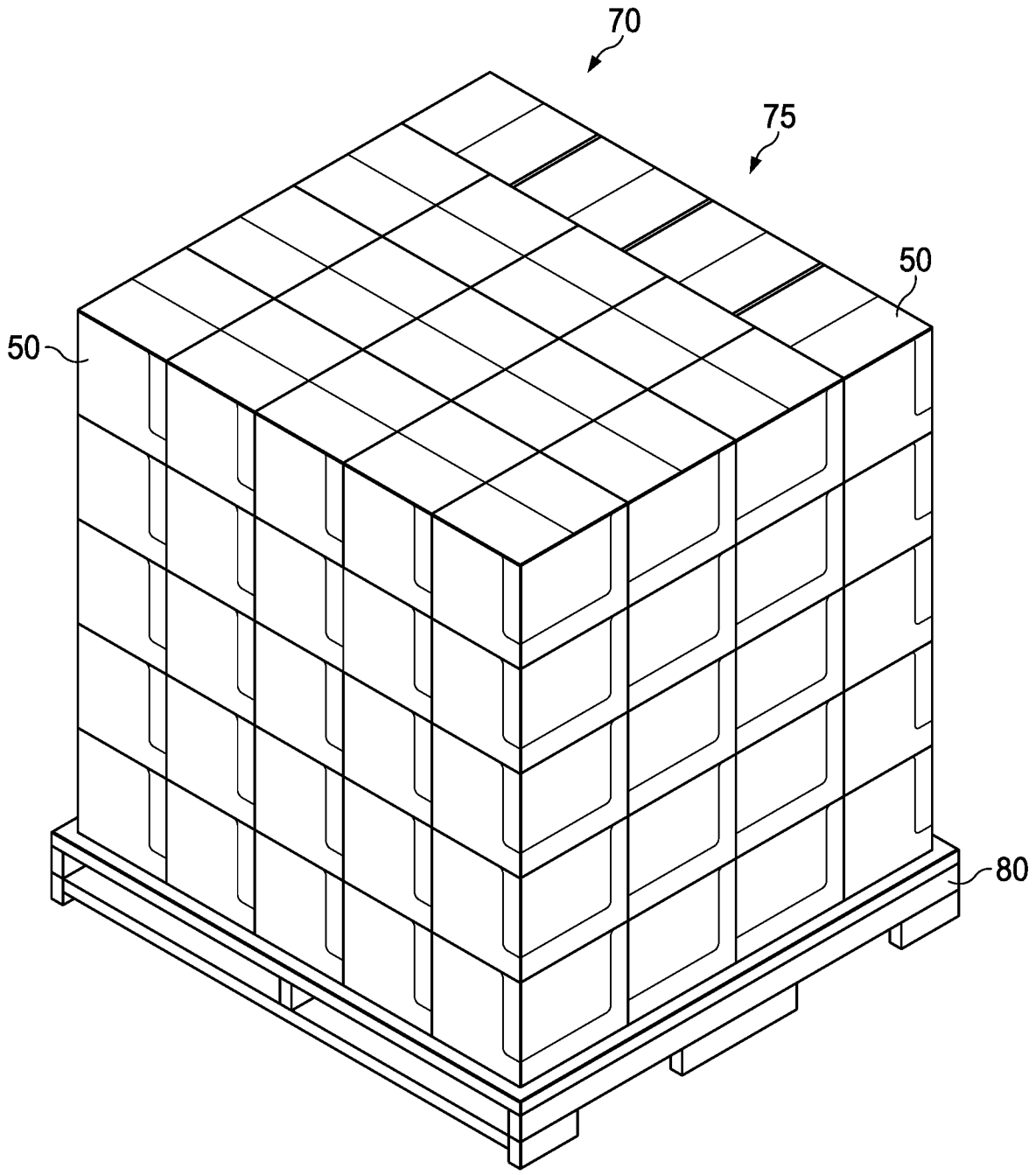
FIG. 7 is a perspective view of a stacked, transportable unit herein.

FIG. 7 is a perspective view of the transportable unit 75 of FIG. 6. It represents and shows stacked structure 70 and transportable unit 75 in three-dimensions to show the configuration and alignment of packages 50 therein. Ideally, stacked structure 70 and transportable unit 75 groups multiple packages 50 in cubed form so that one strengthened, reinforced structure is formed from multiple such structures, i.e., package 50.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A strengthened, self-reinforced package formed from a single blank, comprising:

a. a first panel, having an inside surface and an outside surface positioned oppositely to said inside surface; said first panel having a vertical edge interconnected with a horizontal edge;

b. a second panel attached to said first panel, said second panel having an inside surface and an outside surface positioned opposite to said inside surface; said second panel having a vertical edge interconnected with a horizontal edge; wherein said horizontal edge of said second panel is continuous and interconnected with said horizontal edge of said first panel;

c. a third panel attached to said second panel, said second panel being attached in series between said first panel and said third panel;

d. a fourth panel attached to said third panel, said third panel being attached in series between said second panel and said fourth panel;

e. a fifth panel, having an inside surface and an outside surface positioned oppositely to said inside surface, said fifth panel being attached to said fourth panel, said fifth panel having multiple lines of weakness including at least one horizontal line of weakness interconnected with at least one vertical line of weakness, said fourth panel being attached in series between said third panel and said fifth panel, said fifth panel being held adjacent to said first panel such that said inside surface of said first panel faces said outside surface of said fifth panel thereby strengthening and reinforcing said multiple lines of weakness of said fifth panel; and f. a sixth panel, having an inside surface and an outside surface positioned oppositely to said inside surface, said sixth panel being attached to said fifth panel, said sixth panel having multiple lines of weakness including at least one horizontal line of weakness interconnected with at least one vertical line of weakness, said sixth panel being held adjacent to said second panel such that said inside surface of said second panel faces said outside surface of said sixth panel thereby strengthening and reinforcing said multiple lines of weakness of said sixth panel; wherein said horizontal line of weakness of the sixth panel is continuous and interconnected with said horizontal line of weakness of said fifth panel;

wherein said second panel includes a line of weakness extending along a top of said second panel; and wherein said fourth panel includes a line of weakness extending along a top of said fourth panel.

2. The strengthened, self-reinforced package of claim 1, wherein said third panel includes a line of weakness along a top of said third panel and interconnected between said line of weakness of said second panel and said line of weakness of said fourth panel.

3. The strengthened, self-reinforced package of claim 2, wherein said line of weakness of said third panel includes a caved section.

4. The strengthened, self-reinforced package of claim 2, wherein said vertical and horizontal lines of weakness of said sixth panel, said vertical and horizontal lines of weakness of said fifth panel, said line of weakness of said fourth panel, said line of weakness of said third panel and said line of weakness of said second panel define at least in part a removable section.

5. The strengthened, self-reinforced package of claim 1, wherein said horizontal line of weakness and said vertical line of weakness of said fifth panel extend along said horizontal edge and said vertical edge of said first panel, respectively; and said horizontal line of weakness and said vertical line of weakness of said sixth panel extend along said horizontal edge and said vertical edge of said second panel, respectively.

6. The strengthened, self-reinforced package of claim 5, wherein said horizontal line of weakness and said vertical line of weakness of said fifth panel extend along said horizontal edge and said vertical edge of said first panel, respectively, such that said horizontal line of weakness and said vertical line of weakness of said fifth panel are at least in part tucked beneath said horizontal edge and said vertical edge of said first panel, respectively; and wherein said horizontal line of weakness and said vertical line of weakness of said sixth panel extend along said horizontal edge and said vertical edge of said second panel, respectively, such that said horizontal line of weakness and said vertical line of weakness of said fifth panel are at least in part tucked beneath said horizontal edge and said vertical edge of said second panel, respectively.

7. The strengthened, self-reinforced package of claim 1, wherein said outside surface of said first panel and said outside surface of said second panel face outwardly from said strengthened, self-reinforced package.

8. The strengthened, self-reinforced package of claim 7, wherein said inside surface of said first panel and said inside surface of said second panel face inwardly into said strengthened, self-reinforced package.

9. The strengthened, self-reinforced package of claim 1, wherein said package defines an interior volume capable of housing one or more rigid items.

10. The strengthened, self-reinforced package of claim 9, wherein said one or more rigid items are geometrically similar.

11. The strengthened, self-reinforced package of claim 9, wherein one or more rigid items are geometrically the same.

12. The strengthened, self-reinforced package of claim 11, wherein said one or more rigid items are arrangeable in a two by five orientation within said package.

13. The strengthened, self-reinforced package of claim 12, wherein at least two of said one or more rigid items are positioned adjacent to said multiple lines of weakness.

14. The strengthened, self-reinforced package of claim 1, wherein said package is stackable with like same said strengthened, self-reinforced packages.

15. The strengthened, self-reinforced package of claim 1, wherein said package is stackable with several other said packages to form a transportable unit of strengthened, self-reinforced packages.

16. The strengthened, self-reinforced package of claim 15, wherein said transportable unit comprises no more than ten percent (10%) tear of said lines of weakness for any one said strengthened, self-reinforced package during transport or storage.

17. The strengthened, self-reinforced package of claim 16, wherein said transportable unit comprises no more than five percent (5%) tear of said lines of weakness for any one of said strengthened, self-reinforced packages during transport or storage.

18. The strengthened, self-reinforced package of claim 17, wherein said transportable unit comprises no more than two and one-half percent (2.5%) tear of said lines of weakness for any one said strengthened, self-reinforced package during transport or storage.

19. The strengthened, self-reinforced package of claim 18, wherein said transportable unit comprises no more than one percent (1%) tear of said lines of weakness for any one said strengthened, self-reinforced package during transport.

20. A strengthened, self-reinforced stacked structure comprising multiple strengthened, self-reinforced packages each formed from a single blank, each said multiple self-reinforced package formed from a blank and having, a. a first panel, having an inside surface and an outside surface positioned oppositely to said inside surface; said first panel having a vertical edge interconnected with a horizontal edge;

b. a second panel attached to said first panel, said second panel having an inside surface and an outside surface positioned opposite to said inside surface; said second panel having a vertical edge interconnected with a horizontal edge; wherein said horizontal edge of said second panel is continuous and interconnected with said horizontal edge of said first panel;

c. a third panel attached to said second panel, said second panel being attached in series between said first panel and said third panel;

d. a fourth panel attached to said third panel, said third panel being attached in series between said second panel and said fourth panel;

e. a fifth panel, having an inside surface and an outside surface positioned oppositely to said inside surface, said fifth panel being attached to said fourth panel, said fifth panel having multiple lines of weakness including at least one horizontal line of weakness interconnected with at least one vertical line of weakness, said fourth panel being attached in series between said third panel and said fifth panel, said fifth panel being held adjacent to said first panel such that said inside surface of said first panel faces said outside surface of said fifth panel thereby strengthening and reinforcing said multiple lines of weakness of said fifth panel; and f. a sixth panel, having an inside surface and an outside surface positioned oppositely to said inside surface, said sixth panel being attached to said fifth panel, said sixth panel having multiple lines of weakness including at least one horizontal line of weakness interconnected with at least one vertical line of weakness, said sixth panel being held adjacent to said second panel such that said inside surface of said second panel faces said outside surface of said sixth panel thereby strengthening and reinforcing said multiple lines of weakness of said sixth panel; wherein said horizontal line of weakness of the sixth panel is continuous and interconnected with said horizontal line of weakness of said fifth panel; wherein said second panel includes a line of weakness extending along a top of said second panel; and wherein said fourth panel includes a line of weakness extending along a top of said fourth panel;

wherein said self-reinforced stacked structure is strengthened and reinforced by each said self-reinforced package used to make said self-reinforced stacked structure;

wherein, for three sides of said strengthened, self-reinforced stacked structure, each surface of each said self-reinforced package that forms a side of said strengthened, self-reinforced stacked structure includes at least one of said outside surface of said first panel and said outside surface of said second panel.

21. The strengthened, self-reinforced stacked structure of claim 20, wherein said inside surface of said first panel and said inside surface of said second panel of each said formed, strengthened, self-reinforced package faces inwardly into each said strengthened, self-reinforced package.

22. The strengthened, self-reinforced stacked structure of claim 20, wherein each of said strengthened, self-reinforced packages comprise a volume capable of housing one or more rigid items.

* * * * *